US007441501B2

(12) United States Patent
Masuch

(10) Patent No.: US 7,441,501 B2
(45) Date of Patent: Oct. 28, 2008

(54) PRINTING UNITS COMPRISING BEARING RINGS IN A ROTARY PRESS

(75) Inventor: Bernd Kurt Masuch, Kürnach (DE)

(73) Assignee: Koenig & Aktiengesellschaft, Wurzburg (DE)

( * ) Notice: Subject to any disclaimer, the term of this patent is extended or adjusted under 35 U.S.C. 154(b) by 333 days.

(21) Appl. No.: 10/560,833

(22) PCT Filed: Feb. 20, 2004

(86) PCT No.: PCT/EP2004/050178

§ 371 (c)(1),
(2), (4) Date: Dec. 15, 2005

(87) PCT Pub. No.: WO2004/110761

PCT Pub. Date: Dec. 23, 2004

(65) Prior Publication Data

US 2007/0022886 A1 Feb. 1, 2007

(30) Foreign Application Priority Data

Jun. 17, 2003 (DE) ..... 103 27 490

(51) Int. Cl.
*B41F 13/21* (2006.01)

(52) U.S. Cl. ..... 101/216; 101/219

(58) Field of Classification Search ..... 101/216, 101/219, 248, 375, 376
See application file for complete search history.

(56) References Cited

U.S. PATENT DOCUMENTS

| | | | | |
|---|---|---|---|---|
| 170,542 | A * | 11/1875 | Firm | 101/220 |
| 1,733,707 | A * | 10/1929 | Wood | 101/220 |
| 2,036,835 | A | 4/1936 | Sites | |
| 3,196,788 | A | 7/1965 | Knowles | |
| 5,809,883 | A * | 9/1998 | Rodi | 101/216 |
| 6,314,881 | B1 * | 11/2001 | Gotting | 101/216 |
| 6,502,508 | B1 | 1/2003 | Schaede | |
| 6,782,816 | B1 * | 8/2004 | Bolza-Schunemann | 101/217 |

FOREIGN PATENT DOCUMENTS

| | | |
|---|---|---|
| DE | 207 359 | 2/1984 |
| DE | 195 01 243 | 7/1996 |
| DE | 199 27 555 | 12/2000 |
| DE | 202 13 169 | 12/2002 |
| FR | 2 527 518 | 12/1983 |
| WO | WO 00/41887 | 1/2000 |
| WO | WO 200054970 A1 * | 9/2000 |

* cited by examiner

*Primary Examiner*—Anthony H. Nguyen
*Assistant Examiner*—Leo T Hinze
(74) *Attorney, Agent, or Firm*—JonesTullarCooper, PC

(57) ABSTRACT

A printing group of a rotary printing press includes a counter-pressure cylinder that forms a printing location in a printing contact position in cooperation with a second cylinder. The second cylinder has a compressible surface. The two cylinders each are provided with bearer rings. A radius of the counter-pressure cylinder is greater, in a band area thereof, than is a radius of the bearer ring which is associated with this counter-pressure cylinder.

30 Claims, 5 Drawing Sheets

PRINTING UNITS COMPRISING BEARING RINGS IN A ROTARY PRESS

CROSS-REFERENCE TO RELATED APPLICATIONS

This application is the U.S. National Phase, under 35 USC 371, of PCT/EP2004/050178, filed Feb. 20, 2004; published as WO 2004/110761 A1 on Dec. 23, 2004, and claiming priority to DE 103 27 490.1, filed Jun. 17, 2003, the disclosures of which are expressly incorporated herein by reference.

FIELD OF THE INVENTION

The present invention is directed to printing units of a rotary printing press. A first cylinder forms a nip point with a second cylinder, that is provided with a resilient surface, when the two cylinders are in a print-on position. The effective radius of the first cylinder is greater than that in the second cylinder in the print-on position.

BACKGROUND OF THE INVENTION

When driving cylinders or groups of cylinders by the use of separate drives, such as, for example, in satellite printing units, process-related unwinding differences between the cylinder pairs can occur. These differences are a function of the contact pressure, the number of active print locations, the thickness of the dressing, the type of dressing, and even the manufacturer of the dressing itself. This is true whether the friction drive is embodied without bearing rings or with bearing rings, or of the bearing rings or of the radius ratios of the friction drive as a whole.

In part, these process-related unwinding differences can lead to considerable and, under changing conditions to different output flows between the cylinders or cylinder groups. This is undesirable, since such differences lead to asymmetries in the output configuration or, depending on the conditions and modes of operation, to different outputs, or even to overloading of the motors and regulating devices.

Even with cylinder groups, printing groups, printing units or printing towers which are operated together by the use of gears, this difference leads to undesired moments, to increased friction and to wear.

Cylinders of a rotary printing press, with bearing rings, are known from DE 195 01 243 A1. The bearing rings of the satellite cylinder are rotatably seated for the purpose of reducing the output transfer.

In WO 00/41887 A1, a compensating friction gear, in the form of bearing rings having a radius ratio not equal to one, is overlaid on a friction gear of cylinders which are in frictional contact for process-related reasons. In this case, the bearing ring of the counter-pressure cylinder is larger than the barrel of the latter and is also larger than the bearing ring of the cooperating transfer cylinder. In the priority document DE 199 27 555 A1, the relationships between the transfer cylinder and the counter-pressure cylinder are shown, in the reversed way, in a drawing figure.

U.S. Pat. No. 3,196,788 discloses a printing group for use in offset printing on two sides. The transfer cylinders and the associated forme cylinder have different radii in the area of their barrels. Three pairs of bearing rings, which are each working together, are arranged on three different levels. Each of the pairs of bearing rings has the same diameter.

In U.S. Pat. No. 2,036,835 A, the ratios of the diameters of the cylinders with respect to each other, are shown in such a way that the transfer cylinder diameter is smaller, and the counter-pressure cylinder and forme cylinder diameters are larger than the diameters of the bearing rings. The bearing ring diameter is identical for all three cylinders.

SUMMARY OF THE INVENTION

The object of the present invention is directed to providing printing units of a rotary printing press.

In accordance with the present invention, this object is attained by the provision of a first cylinder that forms a nip point in cooperation with a second cylinder when the two are in a print-on position. The second cylinder typically has a compressible surface. Bearing rings may be associated with both of these cylinders. In the print-on position, the radius of the first cylinder, or of its associated bearing ring is larger than that of the second cylinder, or its associated bearing ring.

The advantages to be gained by the present invention lie, in particular, in that, because of the special conditions that exist in the area of the friction gear, which is constituted by the cylinders, it is possible to achieve a considerably lower output displacement. Also, a higher print quality is possible because of this, due to so-called "true-rolling".

This advantage applies, in particular, to printing groups that have a cylinder which does not conduct ink, such as, in particular, a satellite cylinder, and which includes several transfer cylinders that are working together with the latter. In this case, the staggering of the three cylinders, in their layout, with relation to each other, is of particular advantage, since not only one cylinder, but several cylinders often contribute to the potential output displacement. A substantial advantage results, in connection with bearing ring rollers, for a bearing ring which is reduced in size in comparison with the satellite cylinder.

In an advantageous embodiment of the present invention, the size of the bearing rings of the three cylinders can be staggered in pairs with respect to each other. If desired, such staggering of the three bearer rings, with respect to each other, can be provided in place of the staggering of the cylinders or, in an advantageous further development, can be provided in addition to the staggering of the cylinders.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
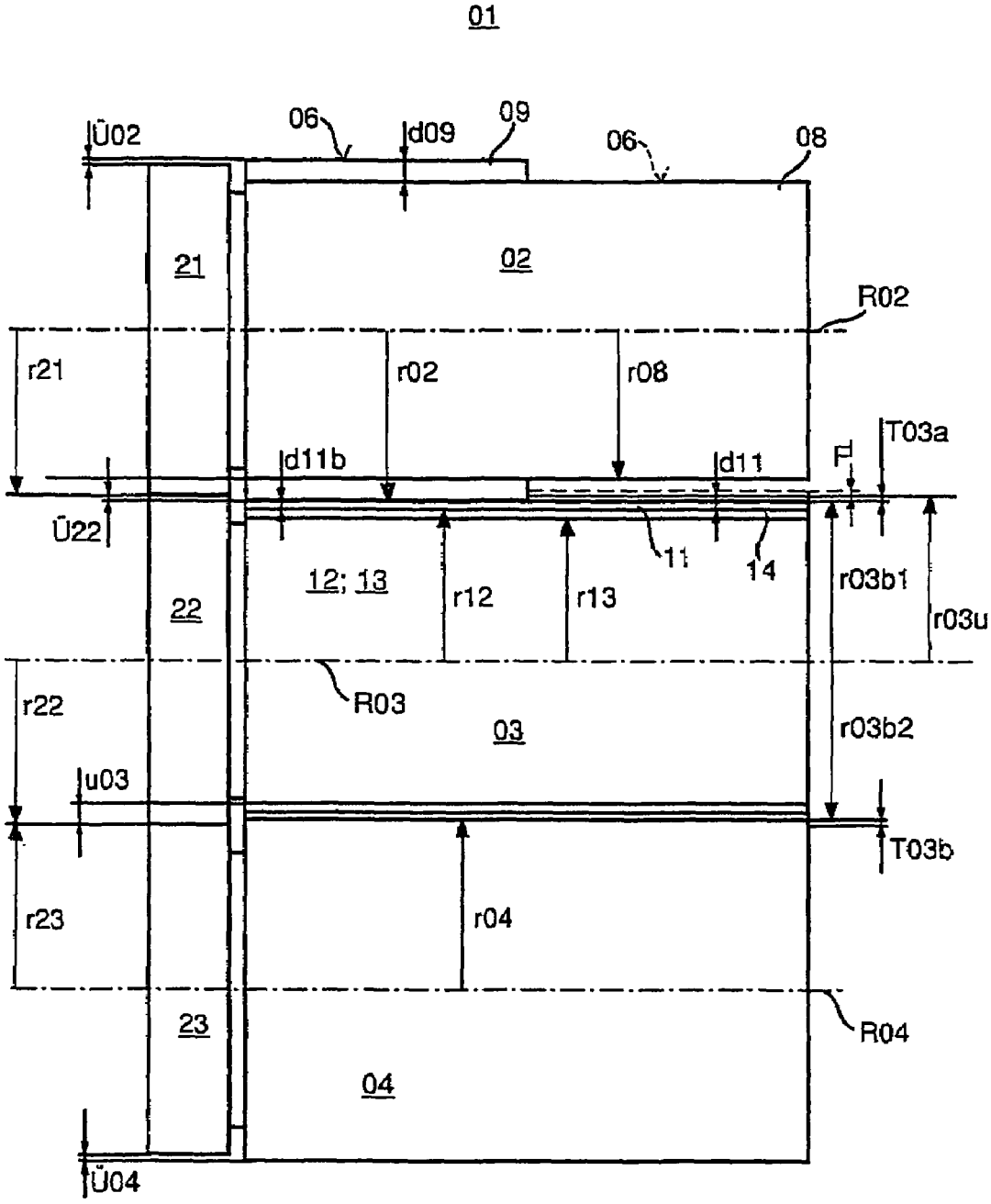
FIG. 1, a schematic representation of cooperating cylinders of a rotary printing press in cooperation with the present invention, in FIG. 2, a portion of a friction bearing of two cylinders in an enlarged view, in FIG. 3, a schematic representation of a nine cylinder printing unit with drive mechanisms which are arranged in pairs, in FIG. 4, a schematic representation of a nine cylinder printing unit with individual drive mechanism, and in FIG. 5, a schematic representation of a 10 cylinder satellite printing unit.

Referring initially to FIG. 1, a rotary printing press has a printing group 01 with three cylinders 02, 03, 04, which, in a print-on position of the printing group 01, work together with each other. For example, the first cylinder 02 is embodied as a forme cylinder 02 and has, on its outwardly oriented outer surface 06 a representation of an image to be printed. The image to be printed can be provided in the form of a structure for letterpress printing, for rotogravure printing or for planographic printing directly on a shell face of the forme cylinder 02 itself. The image can be provided on a printing forme 09, such as a printing plate, sleeve, or printing block, which forme 09 is releasably arranged on a base body 08, of a base body radius r08, of the form cylinder 02 and of a forme thickness d09 of, for example, d09=0.25 to 0.33 mm, and in particular a forme thickness of 0.27 to 0.30 mm. In each one of the above-described two cases, the outer surface 06, which is provided with the printed image, defines an effective radius r02 of the forme cylinder 02. The forme cylinder 02, with the printing forme 09 and, if required, with one or with several intermediate layers, which are not specifically represented, is substantially incompressible, or is provided with a fixed radius r02.

In the area of its shell face, the second cylinder 03, which is preferably embodied as a transfer cylinder 03, has at least one layer 11, which is provided with compressible and/or elastic properties, and which is supported on a substantially incompressible, inelastic cylinder core 12, with the cylinder core 12 of the transfer cylinder 03 having a radius r12. The layer 11, which may be, for example, in the form of a dressing 11, and in particular, a rubber blanket 11, which is ultimately configured as a sleeve, etc., is releasably arranged on the cylinder core 12. The radius r12 of the cylinder core 12 can be defined either by the shell face of the base body 13 of a radius r13 or, in case of the presence of one or of several intermediate layers 14, such as, for example, an underlayer 14, by the surface of the outermost intermediate layer 14. The intermediate layer or layers is or are used for adaptation of the transfer cylinder 03 to various thicknesses d11 of rubber blankets 11, and/or the thickness of materials to be imprinted. If the layer 11 is embodied as a layer 11, which is connected with an incompressible support layer, such as, for example, the layer of a metal blanket, within the meaning of incompressibility, the radius r12 is to be understood to include the thickness of the incompressible support layer, such as, for example, the metal plate.

Figure 2:
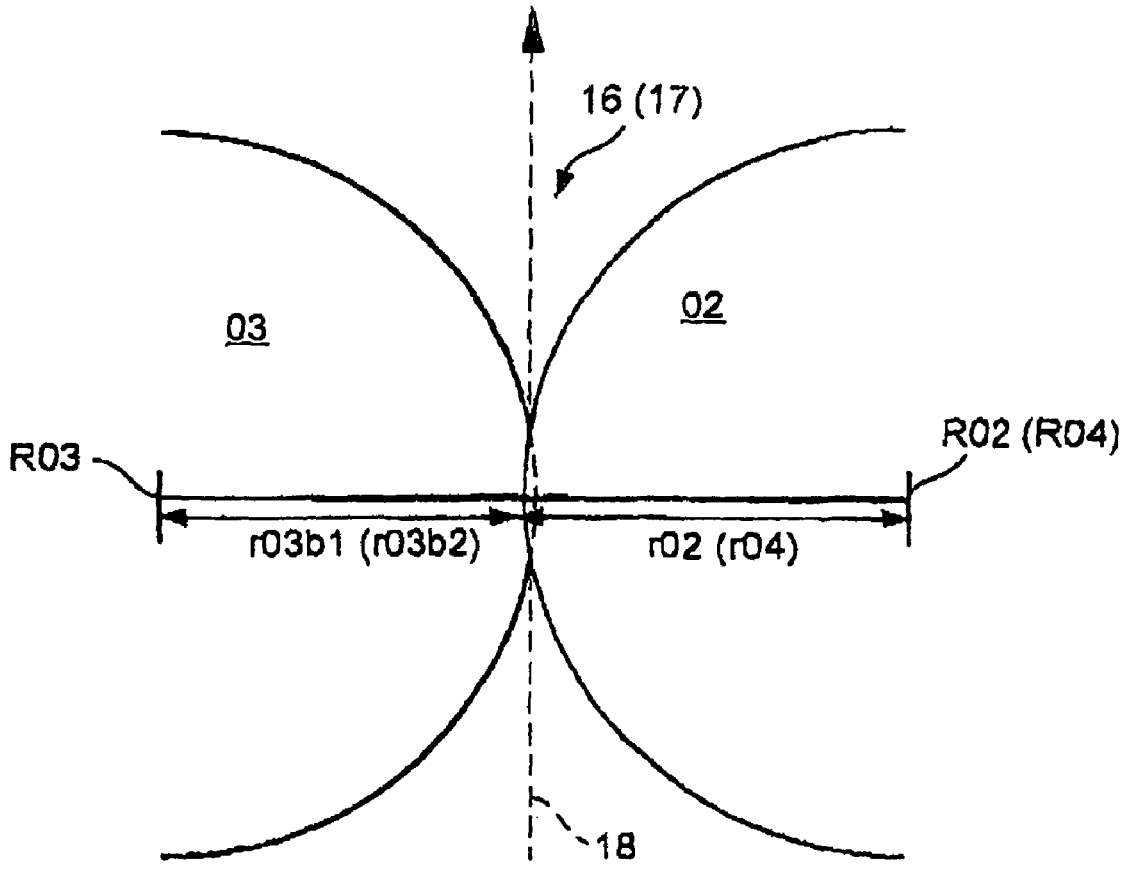

Because of the presence of the elastic and/or of the incompressible layer 11, the transfer cylinder 03 has a first outer radius r03*u* in the unloaded state, i.e. in the print-off position, and has a second outer, or effective radius r03*b* in the loaded state, i.e. in the print-on position of the cylinders 02, 03, 04, which are placed in pairs against each other. In this loaded state, the distance of the axis of rotation R02, R03, R04 of the respective cylinder 02, 03, 04 from the nip point in the connecting plane of the axes of rotation R02, R03, R04 is to be generally understood as the "radius in the loaded state", or the effective radius. In this connection, a distinction should possibly be made between the radius r03*b*1 of the transfer cylinder 03, in the loaded state, in the area of the nip point 16 with the forme cylinder 02, as seen in FIG. 2, and the radius r03*b*2 of the transfer cylinder 03, in the loaded state in the area of the nip point 17 with the further cylinder 04. In FIG. 2, the reference numerals of the nip point 17 between the transfer cylinder 03 and the third cylinder 04 have been placed in parentheses. This nip point 17 simultaneously constitutes a print location 17 for a web 18, shown in FIG. 2 in dashed lines to be imprinted, such as, for example, a paper web 18.

The cylinder 04 which, acting as a counter-pressure cylinder 04, forms a print location together with the transfer cylinder 03, can be embodied either as a transfer cylinder of a second cylinder pair, or as a cylinder 04 which does not conduct ink, and against which cylinder 04 one or several transfer cylinders 03 can be placed in contact by way of a non-represented, intermediate web.

In the embodiment represented in FIGS. 1 and 2, the counter-pressure cylinder 04 is embodied as a cylinder 04 which does not conduct ink and which is embodied to be substantially incompressible, and thus is provided with a fixed outer radius r04. This fixed outer radius r04 can possibly include incompressible layers which are not specifically represented and which are applied to a basic cylinder body. In that case, the cylinder 04 constitutes an effective radius r04, for example, also toward the nip point in the print-on position.

In an advantageous embodiment of the present invention, the forme cylinder 02 and the transfer cylinder 03 which, in the print-on position, form a friction drive, are dimensioned and/or are placed against each other in such a way that, in the loaded state, the forme cylinder 02 has a greater radius r02, such as, for example, a radius which is at least greater by 0.2 per thousand, than the radius r03*b*1 of the transfer cylinder 03 at the nip point 16. A ratio of the radius r02 of the forme cylinder 02 with respect to the radius r03*b*1 of the transfer cylinder 03 in the loaded state, i.e. in the print-on position lies, for example, at a ratio of 1.0015 to 1, up to 1.0030 to 1, and preferably at 1.0020 to 1, up to 1.0025 to 1. In this case, the ratio of the radius r02 of the forme cylinder 02 to the radius r03*u* of the transfer cylinder in the unloaded state can lie between 1.0000 to 1 and 1.0015 to 1, and in particular can lie between 1.0010 to 1 and 1.0015 to 1, for example.

The thickness d11 of the relieved, compressible layer 11, in the unloaded case, and which layer 11 has already been used during the printing process, lies, for example, between 1.5 and 2.5 mm, and in particular lies between 1.8 and 2.1 mm. The radius r12 of the cylinder core 12 of the cylinder 03 should be embodied corresponding to the above mentioned ratios. In this case, it is possibly necessary to also take an intermediate layer 14 of a thickness of, for example 0.14 mm to 0.22 mm, into consideration in the course of dimensioning the radius r13 of the base body 13.

In the case of a printing group 01, having cylinders 02, 03 of double circumference, in other words of a circumference which substantially corresponds to two vertical printed pages which are arranged one behind the other, and in particular which are newspaper pages, the radius r02 of the forme cylinder 02 lies, for example, between 140 mm and up to 190 mm, and in particular lies between 155 and 180 mm. Now, in the print-on position, or the loaded state, the transfer cylinder 03 has a radius r03*b*1 which is smaller by 0.14 mm up to 0.20 mm, and in particular is smaller by 0.16 mm to 0.18 mm, than the radius r02 of the forme cylinder 02. The latter radius is set by the fixed radius r02 of the incompressible forme cylinder 02 and by the relative position of the axes of rotation R02, R03 of the cylinders 02, 03 in respect to each other in the print-on position. However, a maximum radius r12 of the incompressible cylinder core 12, as well as a minimum thickness d11 of the layer 11, must simultaneously be taken into consideration. In an advantageous embodiment of the present invention, the thickness d11 has been selected in such a way that, in the unloaded state, there is an excess dimension T03*a*, as seen in FIG. 1, of approximately 0.13 mm up to 0.21 mm, and in particular of approximately 0.16 mm up to 0.18 mm in comparison with the loaded state, in which loaded state, and because of contact, the layer 11 is pushed in by the stated amount by the forme cylinder 02, which corresponds to the indentation depth. If a previously unused rubber blanket 11 is employed, the transfer cylinder 03 initially has a radius r03*u* in the unloaded state which is greater by a penetration thickness F, which is represented in dashed lines in FIG. 1, of, for example, 0.02 mm to 0.05 mm, as well as a correspondingly increased excess dimension T03*a*.

A contact position is preset, for example by the use of one or of several stops, in such a way that, in their contact position, the two cylinders 02, 03 have the above mentioned radius ratio in the area of the nip point 16, which, as seen in FIG. 2 is located in the connecting plane of the axes of rotation R02, R03, and wherein, in an advantageous further development, a ratio between the excess dimension T03*a* and the thickness d11 of the layer 11 lies between 5% and 15% in the unloaded or collapsed state.

In an advantageous embodiment of the present invention, the transfer and counter-pressure cylinders 03, 04, which together constitute a friction gear drive in the print-on position, are dimensioned or are placed against each other in such a way that the forme cylinder 02 also has a greater radius r02, for example at least greater by 0.1 per thousand, than the radius r04 of the counter pressure cylinder 04. A ratio of the radius r02 of the forme cylinder 02 to the radius r04 of the counter-pressure cylinder 04 preferably lies between 1.0001 to 1 and 1.0002 to 1.

In the case of the above mentioned printing group 01, with cylinders 02, 03 of double circumference, the counter-pressure cylinder 04 has a radius r04 which is smaller by 0.02 mm to 0.10 mm, and in particular by 0.04 mm to 0.06 mm, than the radius r02 of the forme cylinder 02.

A distance for the print-on position between the axes of rotation R03, R04 of the transfer cylinder 03 and of the incompressible counter-pressure cylinder 04 is selected in such a way that in the loaded state, a ratio between the radius r04 of the counter-pressure cylinder and the radius r03*b*2 of the transfer cylinder 03 lies between 1 to 1.001 and 1 to 1.003. This is set by the fixed radius r04 of the incompressible counter-pressure cylinder 04 and by the relative position of the axes of rotation R04, R03 of the cylinders 04, 03 with respect to each other in the print-on position. However, a maximum radius r04 of the incompressible cylinder 04, as well as a minimal thickness d11 of the layer 11 must simultaneously be taken into consideration. In an advantageous embodiment of the invention, the thickness d11 has been selected in such a way that, in the unloaded state there is an excess dimension T03*b* of approximately 0.13 mm up to 0.21 mm, and in particular of approximately 0.16 mm up to 0.18 mm in comparison with the loaded state, in which state, and because of contact, the layer 11 is pushed in by the stated amount by the counter-pressure cylinder 04. If a previously unused rubber blanket 11 is employed, the transfer cylinder 03 initially has, as discussed above, a radius r03*u*, in the unloaded state, which is greater by a penetration thickness F, which is represented in dashed lines in FIG. 1, of, for example, 0.02 mm to 0.05 mm, as well as a correspondingly increased excess dimension T03*b*.

A contact position is preset, for example by the use of one or of several stops, in such a way that, in their contact position, the two cylinders 03, 04 have the above-mentioned radius ratio in the area of the nip point 17 which nip point 17 lies in the connecting plane of the axes of rotation R03, R04, and wherein, in an advantageous further development, a ratio between the excess dimension, or the penetration depth T03*b*, and the thickness d11 of the layer 11 lies between 5% and 15% in the unloaded or collapsed state.

The above-mentioned conditions can be used, in a first embodiment, for cylinders 02, 03, 04 without bearing rings or, in a second embodiment, can also be used for cylinders 02, 03, 04 with bearing rings 21, 22, 23, as represented in FIG. 1.

In connection with the above-mentioned embodiments of the friction gears or drives between the cylinders 02, 03, 04, in a second embodiment the bearing rings 21, 22, 23 can all have the same radius r21, r22, r23. In this case, the radius conditions between respectively two cylinders 02, 03, 04 and those of the associated bearing rings 21, 22, 23 differ from each other. For primarily making possible a roll-off behavior, which is determined by the described friction gears or driving of the cylinders 02, 03, 04, friction-reducing steps, such as, for example, increased lubrication, can be provided for the bearing rings 21, 22, 23. However, the bearing rings 21, 22, 23 can also be rotatably connected with the respective cylinders 02, 03, 04, so that a relative rotation of the bearing rings 21, 22, 23 with respect to their assigned cylinder 02, 03, 04 is made possible.

In an advantageous third embodiment of the present invention, the friction gears or driving of the cylinders 02, 03, 04 as described above, as well as the friction gears or drives of the bearing rings 21, 22, 23, as described in what follows, have special radius ratios which are not equal to 1.

In an advantageous embodiment, the bearing ring 21 of the forme cylinder 02 has a radius r21, so that the ratio between the radius r02 of the forme cylinder 02, or of its surface 06, and that of the bearing ring r21 lies between 1.0007 to 1 and 1.0015 to 1, and preferably is greater than 1.0009 to 1 and up to 1.0013 to 1, inclusive. For a cylinder 02 of double circumference, an overhang Ü02 of the surface 06, with respect to the bearing ring 21 lies between 0.10 mm and 0.23 mm, and in particular lies between 0.15 mm and 0.19 mm. With a thickness d09 of the printing forme 09 of, for example, 0.25 mm to 0.33 mm, this must accordingly be taken into consideration in case of the dimensioning of the base body 08 with an undercut u02 with respect to the bearing ring 21. For example, the undercut u02 lies between 0.11 mm and 0.15 mm.

The bearing ring 23 of the counter-pressure cylinder 04 has a radius r23, so that the ratio between the radius r04 of the counter-pressure cylinder 04 and the radius of the bearing ring r23 lies between 1.0004 to 1 to 1.0012 to 1, and in particular lies between 1.0006 to 1 and maximally 1.0009 to 1. For a cylinder 04 of double circumference, an overhang 004 of the surface 06, with respect to the bearing ring 23 lies between 0.06 mm and 0.18 mm, in particular lies between 0.08 mm and 0.16 mm.

The bearing ring 22 of the transfer cylinder 03 has a radius r22, so that the ratio between the effective radius r03*b*1 in the print-on position of the transfer cylinder 03 and that of the bearing ring r22 lies between 0.9978 to 1 and 0.9996 to 1, and in particular lies between 0.9984 to 1 and 0.9990 to 1. For a cylinder 03 of double circumference, an overhang 022 of the bearing ring 22, with respect to the effective radius r031b, lies between 0.13 mm and 0.22 mm, and in particular lies between 0.15 mm and 0.20 mm. With a thickness d11 of the layer 11 in the loaded state of, for example, 1.03 mm to 2.30 mm, this must accordingly be taken into consideration in case of the dimensioning of the cylinder core 12 or of the base body 13 and the possibly intermediate layer or layers 14 with an undercut u03 with respect to the bearing ring 22. For example, the undercut u03 lies between 1.6 mm and 2.6 mm.

To meet the requirements made on the ratio of the radii r22 and r03*b* in the contact position in particular, the radii r21, r22, r23 of the bearing rings 21, 22, 23 have a special relationship with each other, which relationship is explained in what follows:

The bearing rings 21 and 23 of the forme and of the counter-pressure cylinders 02, 04 have the same radius r21, r23, therefore the ratio is 1 to 1.000. However, the ratio of the radii r21, r22 of the bearing ring 21 assigned to the forme cylinder 02, with respect to the bearing ring 22 assigned to the transfer cylinder 03 lies in the range between 1.0010 to 1 and 1.0020 to 1, and in particular lies in the range between 1.0010 to 1 and 1.0016 to 1. For cylinders 02, 03 of double circumference, the radius r21 of the bearing ring 21 is, for example, greater by 0.01 mm to 0.03 mm, and in particular by approximately 0.020 mm±0.005 mm, i.e. 0.015 mm to 0.025 mm, than that of the transfer cylinder 03. What has been said above also correspondingly applies to the ratio between the radii r23 of the bearing ring 23 assigned to the counter-pressure cylinder 04 and to the bearing ring 82 of the transfer cylinder. The above-mentioned conditions and sizes of the radii lead to differences in the diameter of between 0.02 mm and 0.06 mm, and are therefore different, in a pronounced way, from the difference based on the presently customary manufacturing tolerance of merely approximately 0.004 mm. It is therefore necessary to specifically attain the mentioned values. They are not based merely on chance occurrences occurring in the course of the manufacturing process.

In a fourth preferred embodiment of the present invention, each of the pairs of friction gears or drives has a transmission ratio, or a radius ratio of 1.000, in the contact position. Only the friction gears or drives between two bearing rings 21, 22, 23 acting together in pairs have the above mentioned radius ratios, or transmission ratios which differ from 1.000.

Figure 3:
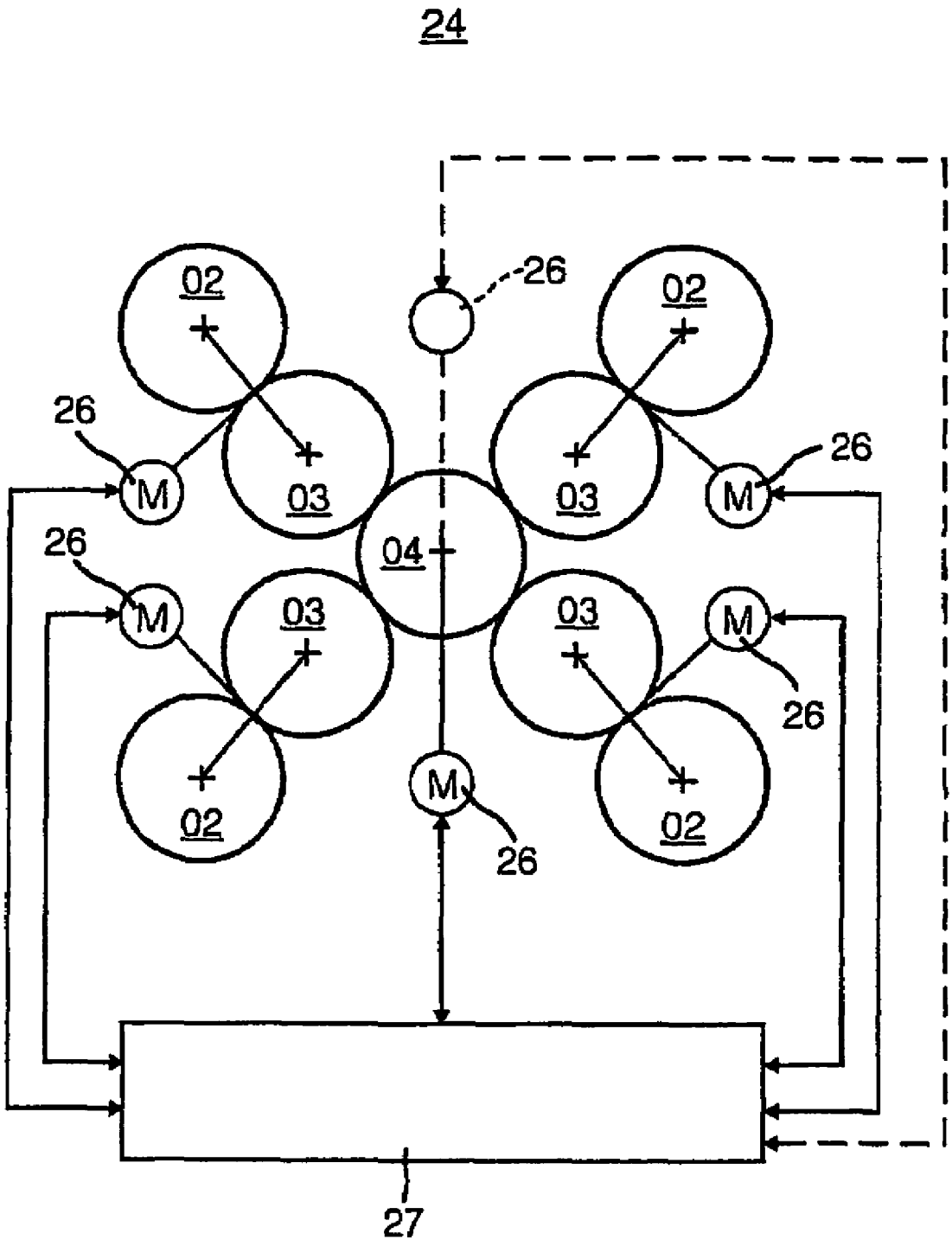

The embodiments shown and discussed above are of particular advantage in connection with printing units whose cylinders 02, 03, 04, or whose printing groups 01, are driven individually, in pairs, or in groups. This is of particular advantage, in view of undesired output displacements, between the printing groups 01 in the configuration represented in FIG. 3, if several transfer cylinders 03 of several printing groups 01 act together with one mutual counter-pressure cylinder 04, which is configured as a satellite cylinder 04. FIG. 3 shows a printing unit 24 which is configured as a nine-cylinder printing unit 24, and in which four pairs of forme and transfer cylinder 02, 03 are assigned to the counter-pressure cylinder 04, which is embodied as a satellite cylinder 04.

In an embodiment, which is not specifically represented, two adjoining cylinder pairs 02, 03 are each, for example, driven as a compound driven unit by a drive motor 26. The satellite cylinder 04 can be driven by one of the two compound driven units. It can also be driven by its own, third drive motor 26.

In the embodiment which is represented in FIG. 3, the cylinders 02, 03, 04 of the nine-cylinder printing group 24 are driven for rotational movement by five drive motors 26. Each cylinder pair 02, 03, and the counter-pressure cylinder 04 which is embodied as a satellite cylinder 04, has its own, at least rpm-regulated drive motor 26, each of which drive motors is mechanically independent of the other drive motors 26. The compound driven units formed by this arrangement of drive motors 26 have no mechanical coupling with each other, except for the previously described friction gears or drives. In one variation, the satellite cylinder 04 is simultaneously driven by two drive motors 26, and wherein one of these two respective drive motors 26, together with the drive motors 26 of two respective cylinder pairs, is supplied by a common device which is connected to the electrical network. This permits a symmetrical layout of the supply of the rotatory drive mechanisms of the nine-cylinder printing unit 24 by the use of two common devices which are connected to the electrical network.

The drive motors 26 are in a signal connection with a control and/or a computing unit 27, for example, from which they receive desired value specifications regarding their number of revolutions. The control and/or computing unit 27 includes a so-called "electronic shaft", such as elements for use in electronically synchronizing the drive motors 26. In a preferred embodiment, the drive motors 26, or at least those of the several cylinder pairs, are configured as drive motors 26 which can be regulated with regard to their angle of rotation position. They receive specific values regarding their angle of rotation position through the control and/or the computing unit 27.

Figure 4:
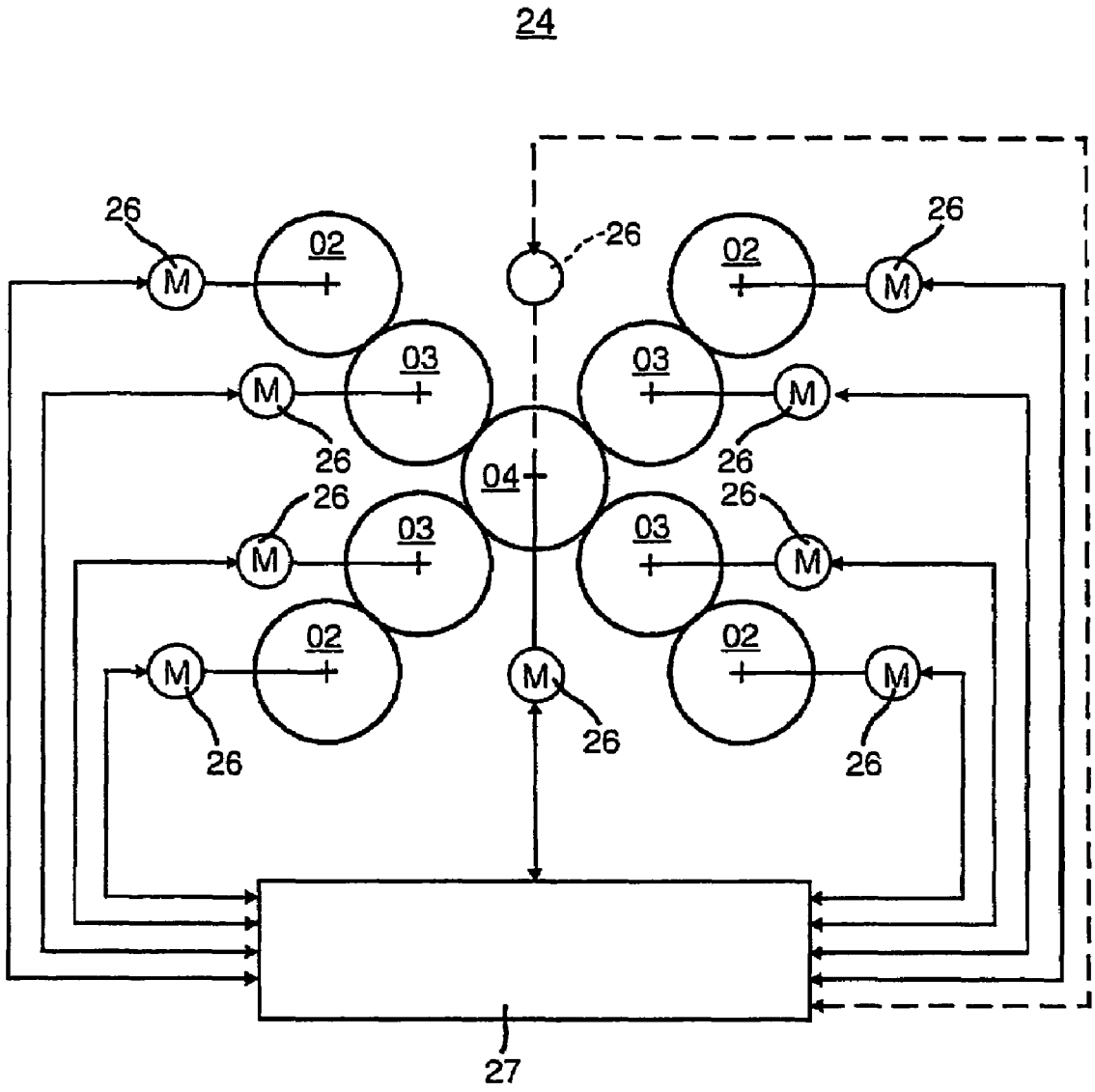

In an embodiment of the present invention, which is represented in FIG. 4, each one of the cylinders 02, 03, 04 has its own drive motor 26, each which drive motor 26 is mechanically independent of the drive motors 26 of the other cylinders 02, 03, 04. What has been said above should be applied in an analogous manner regarding the embodiment of the drive motors 26, the control and/or computing unit 27, a possibly second drive motor 26 for the satellite cylinder 04, as well as the supply of information by two devices that are connected to the electrical network.

Figure 5:
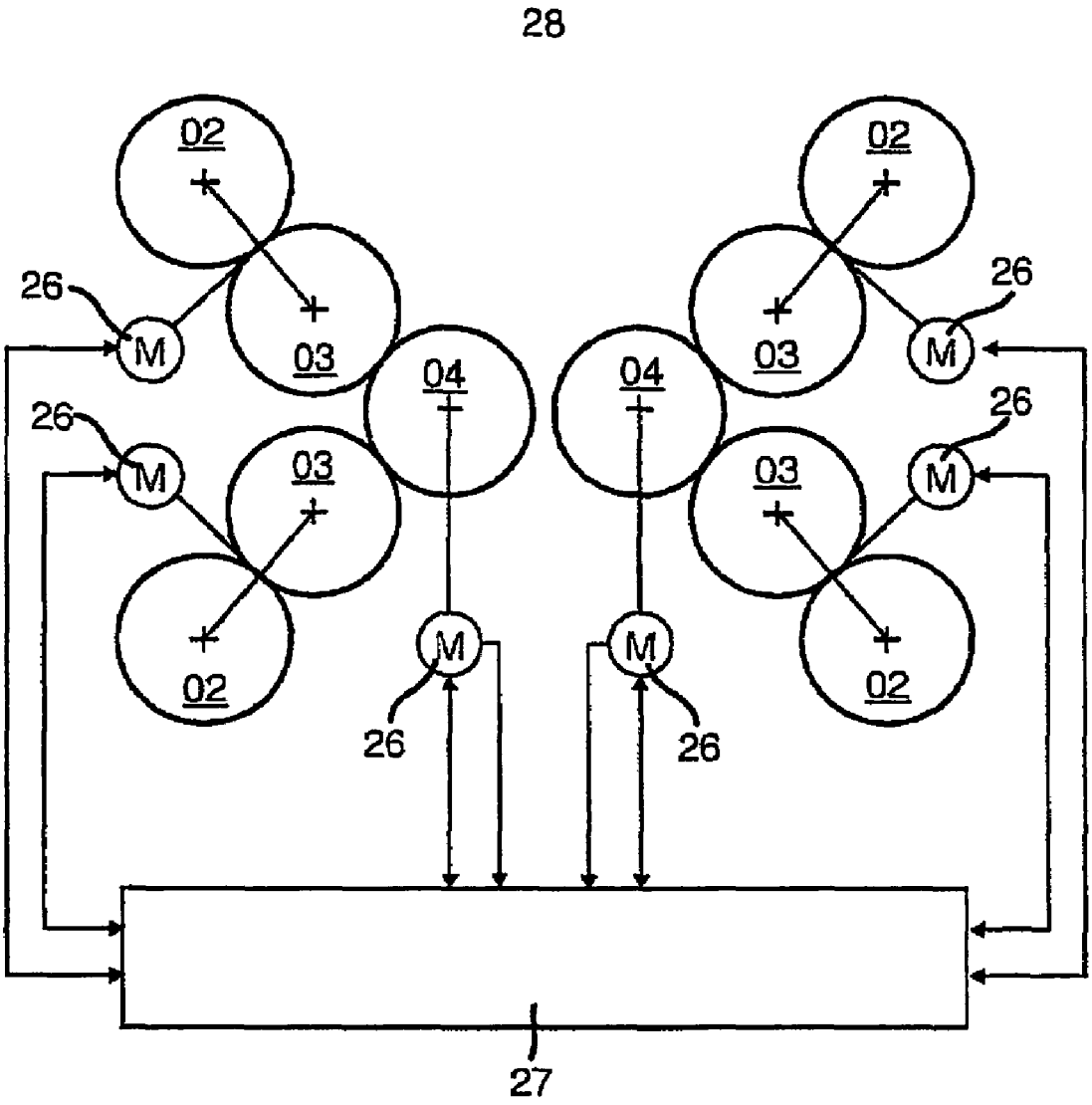

If, as represented in FIG. 5, the printing unit 24 is embodied as a ten-cylinder printing unit 28 with two satellite cylinders 04 assigned to the four cylinder pairs, the two separate satellite cylinders 04 can, as previously mentioned above, each be included in respective compound driven units, each of which includes two cylinder pairs. The two satellite cylinders 04 can have one or two (common) individual drive motor 26, or can each be driven mechanically independently of each other by their own drive motors 26, as represented. Again the above mentioned drive in pairs as represented in FIG. 5, or an individual drive of the cylinders 02, 03, 04, as depicted in FIG. 4 is provided for the pairs.

The cylinders 02, 03, 04, which are driven individually or in pairs, can be, for example, driven directly or indirectly, for example via a gear which is not represented, for example a toothed wheel, a toothed belt or a friction gear.

In one embodiment of the present invention, at least the transfer and the counter-pressure cylinders 03, 04 each have a circumference, of, for example, between 850 mm and 1,300 mm, and in particular from 940 mm to 1,200 mm. The forme cylinder 02, also has this circumference, which is selected for receiving, for example, four vertical printed pages, and in particular newspaper pages arranged side-by-side. The length of the usable barrel of the cylinders 02, 03, 04 is, for example, from 1,100 mm to 1,800 mm, and in particular is from 1,400 mm to 1,700 mm.

The above embodiments can also be applied in connection with cylinders 02, 03, 04 of single circumference or, for example, in connection with a forme and/or transfer cylinder 02, 03 of single circumference, and a counter-pressure cylinder of double circumference. The width of the cylinders 02, 03, 04 can be single, double, triple or quadruple.

Due to drive outputs, which are high anyway, the previously described embodiments are also advantageous in connection with particularly wide, such as, for example, 1,850 to 2,400, and thick, such as, for example, double circumference, cylinders 02, 03, 04. The circumference of the cylinders is embodied for receiving two vertical printed pages, such as, for example, two newspaper pages in broadsheet format, by the use of two dressings, such as, for example, flexible printing formes, which flexible printing formes can be fixed in place on the forme cylinder 02 one behind the other in the circumferential direction. In the axial direction, the forme cylinder 02 is sized to receive, for example, at least six vertical printed pages arranged side-by-side, and in particular is sized to receive six or more newspaper pages in broadsheet format. In this case, it is a function, among other things, of the product to be produced, whether only one printed page, or several printed pages respectively are arranged side-by-side on a printing forme. The transfer cylinder 03 is occupied, in the linear direction, with, for example, three dressings 11 arranged side-by-side, such as, for example, three rubber blankets 11. In the circumferential direction, these three dressing extend substantially around the entire circumference of the transfer cylinder 03. For example, the rubber blankets 11 are arranged alternatingly offset with respect to each other, by, for example, 180°, and have a beneficial effect on the oscillation behavior of the printing group 01 during operation.

A ratio of a length of the usable barrel of the cylinders 02, 03, 04 to their diameter preferably is from 5.8 to 1 to 8.8 to 1, and for example is from 6.3 to 1 to 8.0 to 1, in a wide embodiment, typically of six printed pages wide in particular, is from 6.5 to 1 to 8.0 to 1.

In this case, the length of the usable barrel is to be understood to be that width or length of the barrel, which is suitable for receiving dressings. This width also approximately corresponds to a maximally possible web width of a web to be imprinted. In this case, possibly existing bearing rings, operating areas or rivets in the area of the shell face, and located close to the end faces of the cylinder are not considered.

While preferred embodiments of printing units comprising bearing rings in a rotary press, in accordance with the present invention, have been set forth fully and completely hereinabove, it will be apparent to one of skill in the art that various changes in, for example, the types of printing formes and dressings used, the clamping structures used to secure these formes and dressings to the cylinders, and the like could be made without departing from the true spirit and scope of the present invention which is accordingly to be limited only by the appended claims.

What is claimed is:

1. A printing unit of a rotary printing press comprising:

a first cylinder having a first cylinder barrel with a first cylinder barrel radius;

a second cylinder having a second cylinder radius, said first cylinder and said second cylinder defining a nip point in a print-on position;

first bearing rings assigned to said first cylinder and having a first bearing ring radius, said first cylinder barrel radius being greater than said first bearing ring radius; and second bearing rings assigned to said second cylinder and having a second bearing ring radius, said first bearing ring radius being greater than said second bearing ring radius.

2. The printing unit of claim 1 wherein said first cylinder barrel radius is greater than said second cylinder radius in said print-on position.

3. The printing unit of claim 1 wherein said first cylinder is a counter-pressure cylinder.

4. The printing unit of claim 3 wherein a ratio of said counter-pressure cylinder radius to said first bearing rings radius is between 1.004 to 1 and 1.0012 to 1.

5. The printing unit of claim 4 wherein said ratio is between 1.006 to 1 and 1.0009 to 1.

6. The printing unit of claim 3 wherein said counter-pressure cylinder radius is greater than said first bearing ring radius by from 0.06 mm to 0.18 mm.

7. The printing unit of claim 3 wherein said counter-pressure cylinder radius is greater than said first bearing rings radius by from 0.08 mm to 0.16 mm.

8. The printing unit of claim 3 wherein said counter-pressure cylinder is a satellite cylinder and is adapted to act with several second cylinders each having a compressible surface.

9. The printing unit of claim 8 wherein said printing unit is a nine-cylinder printing unit.

10. The printing unit of claim 8 wherein said printing unit is a ten-cylinder printing unit.

11. The printing unit of claim 10 further including first and second counter-pressure cylinders and a drive motor for said first and second counter-pressure cylinders.

12. The printing unit of claim 10 further including first and second counter-pressure cylinders and a separate drive motor for each of said first and second counter-pressure cylinders.

13. The printing unit of claim 3 further including an independent drive motor assigned to said counter-pressure cylinder.

14. The printing unit of claim 1 wherein said first cylinder is a forme cylinder.

15. The printing unit of claim 14 wherein a ratio of said first cylinder barrel radius to said second cylinder radius at said nip point is between 1.0015 to 1 and 1.0030 to 1.

16. The printing unit of claim 15 wherein said second cylinder is a transfer cylinder and further including a compressible layer on said transfer cylinder.

17. The printing unit of claim 16 further including a counter-pressure cylinder having counter-pressure cylinder bearing rings, said transfer cylinder cooperating with said counter-pressure cylinder in said print-on position and defining a printing location in cooperation with said counter-pressure cylinder.

18. The printing unit of claim 17 wherein a ratio of said counter-pressure cylinder radius to said first bearing rings radius is between 1.004 to 1 and 1.0012 to 1.

19. The printing unit of claim 18 wherein said ratio is between 1.006 to 1 and 1.0009 to 1.

20. The printing unit of claim 17 wherein a radius of said counter-pressure bearing rings is between 0.01 mm and 0.03 mm greater than said transfer cylinder bearing rings radius.

21. The printing unit of claim 1 wherein said second cylinder is a transfer cylinder.

22. The printing unit of claim 21 further including a counter-pressure cylinder having counter-pressure cylinder bearing rings, said transfer cylinder cooperating with said counter-pressure cylinder in said print-on position and defining a printing location in cooperation with said counter-pressure cylinder.

23. The printing unit of claim 22 wherein a radius of said counter-pressure bearing rings is between 0.01 mm and 0.03 mm greater than said transfer cylinder bearing rings radius.

24. The printing unit of claim 22 wherein said transfer cylinder bearing ring radius is smaller than said counter-pressure bearing ring radius.

25. The printing unit of claim 22 wherein said first cylinder barrel radius is greater than said transfer cylinder radius and said transfer cylinder radius is smaller than a radius of said counter-pressure cylinder.

26. The printing unit of claim 1 wherein said first cylinder is a forme cylinder and said second cylinder is a transfer cylinder.

27. The printing unit of claim 1 wherein said second cylinder is a forme cylinder and further including a compressible printing forme on said forme cylinder.

28. The printing unit of claim 1 wherein said first bearing ring radius is greater than said second bearing ring radius by from 0.015 mm to 0.25 mm.

29. The printing unit of claim 1 further including a separate drive motor assigned to each said cylinder.

30. The printing unit of claim 1 further including one drive motor assigned to said first cylinder and said second cylinder.

* * * * *

UNITED STATES PATENT AND TRADEMARK OFFICE

CERTIFICATE OF CORRECTION

PATENT NO. : 7,441,501 B2
APPLICATION NO. : 10/560833
DATED : October 28, 2008
INVENTOR(S) : Bernd Kurt Masuch It is certified that error appears in the above-identified patent and that said Letters Patent is hereby corrected as shown below:

Please correct the name of the assignee, as set forth at section (73) of the cover page of the patent, as follows:

change "Koenig & Aktiengesellschaft" to
--Koenig & Bauer Aktiengesellschaft--

Signed and Sealed this

Fifth Day of May, 2009

JOHN DOLL
*Acting Director of the United States Patent and Trademark Office*